US007972396B2

(12) United States Patent
Feng et al.

(10) Patent No.: US 7,972,396 B2
(45) Date of Patent: Jul. 5, 2011

(54) METHOD OF PRODUCING POLISHING PAD

(75) Inventors: Chung-Chih Feng, Kaohsiung (TW); I-Peng Yao, Kaohsiung (TW); Yung-Chang Hung, Kaohsiung (TW)

(73) Assignee: San Fang Chemical Industry Co., Ltd., Kaoshiung (TW)

( * ) Notice: Subject to any disclaimer, the term of this patent is extended or adjusted under 35 U.S.C. 154(b) by 953 days.

(21) Appl. No.: 11/859,928

(22) Filed: Sep. 24, 2007

(65) Prior Publication Data

US 2008/0047205 A1 Feb. 28, 2008

Related U.S. Application Data

(63) Continuation-in-part of application No. 11/175,212, filed on Jul. 7, 2005, now abandoned.

(51) Int. Cl.
*B24D 3/34* (2006.01)

(52) U.S. Cl. ..... 51/295

(58) Field of Classification Search ..... None
See application file for complete search history.

(56) References Cited

U.S. PATENT DOCUMENTS

| | | | | |
|---|---|---|---|---|
| 4,927,432 | A | 5/1990 | Budinger et al. | |
| 5,197,999 | A | 3/1993 | Thomas | |
| 5,578,362 | A | 11/1996 | Reinhardt et al. | |
| 6,089,965 | A | 7/2000 | Otawa et al. | |
| 6,117,000 | A | 9/2000 | Anjur et al. | |
| 6,217,434 | B1 | 4/2001 | Roberts et al. | |
| 6,368,200 | B1 | 4/2002 | Merchant et al. | |
| 6,383,066 | B1 * | 5/2002 | Chen et al. | 451/532 |
| 6,454,634 | B1 | 9/2002 | James et al. | |
| 6,533,645 | B2 | 3/2003 | Tolles | |
| 6,626,740 | B2 * | 9/2003 | Baker et al. | 451/41 |
| 6,641,463 | B1 | 11/2003 | Molnar | |
| 6,852,020 | B2 | 2/2005 | Petroski et al. | |
| 6,989,117 | B2 | 1/2006 | Chen et al. | |
| 7,141,155 | B2 * | 11/2006 | Bunyan et al. | 205/640 |
| 2002/0077034 | A1 | 6/2002 | Tolles | |
| 2003/0003846 | A1 | 1/2003 | Tolles | |
| 2004/0048559 | A1 * | 3/2004 | Park et al. | 451/288 |
| 2004/0224623 | A1 | 11/2004 | Nishiyama et al. | |
| 2005/0215177 | A1 | 9/2005 | Prasad | |
| 2005/0255794 | A1 | 11/2005 | Vangsness et al. | |

FOREIGN PATENT DOCUMENTS

| | | |
|---|---|---|
| TW | 486407 | 11/2000 |

* cited by examiner

*Primary Examiner* — Melvin C Mayes
*Assistant Examiner* — Stefanie Cohen
(74) *Attorney, Agent, or Firm* — Sughrue Mion, PLLC

(57) ABSTRACT

The present invention relates to a method of producing a polishing pad, comprising steps of: (a) providing a base material comprising a plurality of fibers; said base material having a surface for polishing a substrate, wherein the fibers comprise a core and a cladding surrounding the core, and the cladding comprises a hydrophobic polymer; (b) impregnating the surface of the base material with an elastomer solution; (c) coagulating the elastomer impregnated in the surface of the base material to mold the elastomer and to form a plurality of first continuous pores between the elastomer, and between the elastomer and the fibers; (d) planarizing the surface of the base material; (e) impregnating the surface of the base material and elastomer obtained in the step (d) with a condition polymer solution; and (e) curing the condition polymer impregnated in the surface of the base material and elastomer and partially filling the condition polymer into the first continuous pores to form a plurality of second continuous pores.

21 Claims, 1 Drawing Sheet

METHOD OF PRODUCING POLISHING PAD

CROSS-REFERENCE TO RELATED APPLICATION

This application is a Continuation-In-Part of U.S. patent application Ser. No. 11/175,212, filed Jul. 7, 2005 now abandoned. The entire disclosure of the prior application, application Ser. No. 11/175,212, is hereby incorporated by reference.

BACKGROUND OF THE INVENTION

1. Field of the Invention

The present invention relates to a method for producing a polishing pad for use in a chemical mechanical polishing.

2. Description of the Related Art

Chemical mechanical polishing (CMP) is a procedure for planarizing the surface of a substrate with a polishing pad. CMP is generally applied in polishing lens, mirrors, substrates of liquid crystal displays, silicon wafers, and oxidation and/or metal layers on silicon wafers.

U.S. Pat. No. 6,454,634 discloses a polishing pad produced by a method comprising the steps of pouring thermoplastic foam resin in a circular mold to form a casting, skiving the casting into sheets, and mechanically machining macro-channels into the surface of the sheets. The polishing pad comprises a polymeric matrix made of polyurethane and hollow elastic polymeric micropheres are distributed therein. The cell size and distribution in the polishing pad made of thermoplastic foam resin highly depend on the distribution of each component in a mixture for molding and also depend on the distribution of temperature of the circular mold. It is difficult to even out the distribution of each component in a mixture for molding in a circular mold. Furthermore, because of viscoelastic property of polyurethane, a knife used in a skiving step cannot be located on the edge of the sheet precisely and subsequently influences the flatness, size and distribution of the cells. These factors reduce the batch uniformity when producing the polishing pad, and thus a polishing process involved becomes complicated. In another aspect, the cells of the polishing pad in this patent are discontinuous for each other, so that polishing fluid cannot flow smoothly and polishing particles cannot diffuse evenly. Besides, the residues formed during polishing easily stay on the surface of the polishing pad and their removal is poor; as a result, the residues scrap and damage the substrate to be polished.

U.S. Patent Application Publication No. 2004/0224623 A1 discloses a polishing pad having a plate-like shape. The polishing pad comprises fibers and a resin fixing the fibers to form the plate-like shape. The polishing pad has at least one surface layer that is substantially non-porous and comprises organic fibers and a resin fixing the organic fibers. A surface of the surface layer of the polishing pad is mechanically polished, so that the surface layer has a surface on which the organic fibers are exposed. This application also discloses layering a resin-impregnated sheet-form fiber base material and a resin-unimpregnated sheet-form fiber base material and unifying them by thermocompression molding to form a polishing pad. However, the thermocompression molding step easily leads to uneven space formed between the layers. As a result, hardness, flatness, compression ratio, elasticity, and recovery ratio of the surface of the polishing pad are all affected. The density variation of the layers thermocompression molded occurs during molding. Besides, the method of producing with the condition at high temperature (such as 300° C.) and high pressure (such as 196 kN/m) chars and hardens the surface of the polishing pad, and then the polishing pad scraps and damages the substrate to be polished. Furthermore, when producing the polishing pad, migration easily occurs and the polymers cannot be distributed in the sheet-form fiber base evenly. Heat for laminating also affects the quality, such as hardness, elasticity, compression rate, and density of the polishing pad. The factors all reduce the efficiency of polishing.

The fibers in the conventional polishing pad comprise a single polymer. For example, polyethylene terephthalate, which is a hydrophobic polymer, is usually taken for constituting the fibers. The fibers made of polyethylene terephthalate maintain the hydrophobic properties and avoid the influence of slurry when polishing. However, such fibers are hard and easy to scratch the surface of the substrate to be polished. On the contrary, nylon fibers are also common found in the polishing pad. Because nylon fibers are very soft, scratch of the surface of the substrate to be polished is avoided. However, nylon is a hydrophilic polymer, and is easy to react with the slurry and eliminates the efficiency of polishing.

SUMMARY OF THE INVENTION

One object of the present invention is to provide to a method of producing a polishing pad, comprising the steps of:

(a) providing a base material comprising a plurality of fibers; said base material having a surface for polishing a substrate, wherein the fibers comprise a core and a cladding surrounding the core, and the cladding comprises a hydrophobic polymer;

(b) impregnating the surface of the base material with an elastomer solution;

(c) coagulating the elastomer impregnated in the surface of the base material to mold the elastomer and to form a plurality of first continuous pores between the elastomer, and between the elastomer and the fibers;

(d) planarizing the surface of the base material;

(e) impregnating the surface of the base material and elastomer obtained in step (d) with a condition polymer solution; and (f) curing the condition polymer impregnated in the surface of the based material and elastomer and partially filling the condition polymer into the first continuous pores to form a plurality of second continuous pores.

The polishing pad produced according to the method of the invention can avoid the defects of conventional polishing pads produced by molding thermoplastic foam resin. Both the flatness and batch uniformity of the polishing pad according to the invention are better than conventional ones. Furthermore, the method of the invention is also free of thermocompression and lamination, so that the polishing pad according to the invention does not damage the surface of the substrate to be polished. Additionally, the fibers according to the invention remain good hydrophobic and soft properties and avoid the influence of the slurry and the scratch of the substrate to be polished.

DETAILED DESCRIPTION OF THE INVENTION

Figure 1A:
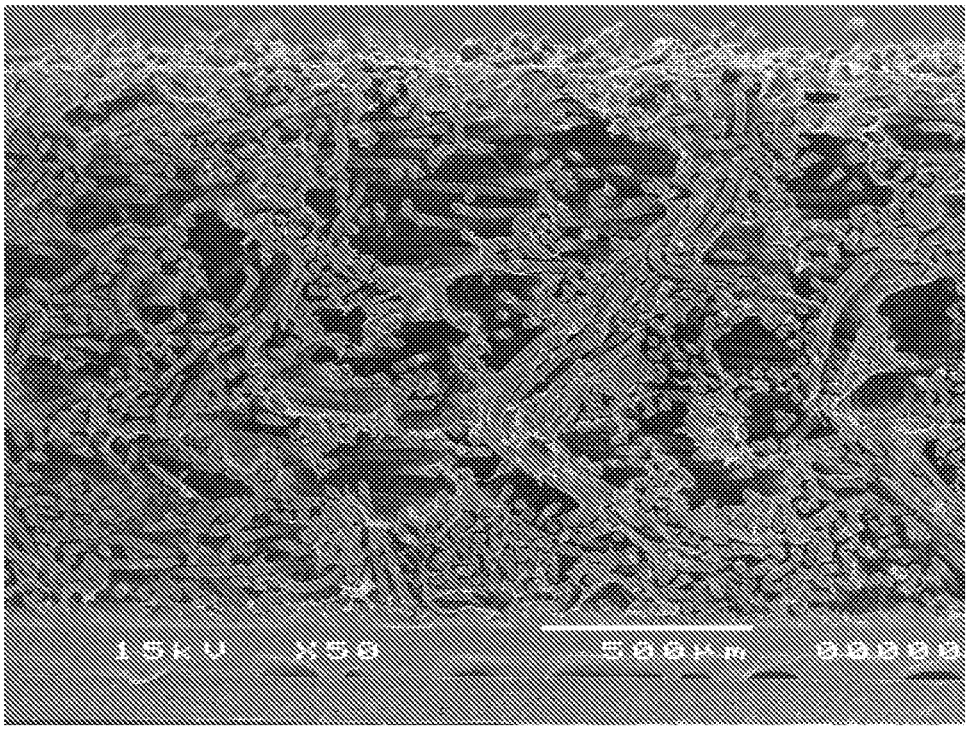
FIG. 1 illustrates views under a transmission electron microscope of a semi-product (1) (a) and a polishing pad (1) (b).

The present invention provides a method of producing a polishing pad, comprising the steps of:

(a) providing a base material comprising a plurality of fibers; said base material having a surface for polishing a substrate, wherein the fibers comprise a core and a cladding surrounding the core, and the cladding comprises a hydrophobic polymer;

(b) impregnating the surface of the base material with an elastomer solution;

(c) coagulating the elastomer impregnated in the surface of the base material to mold the elastomer and to form a plurality of first continuous pores between the elastomer, and between the elastomer and the fibers;

(d) planarizing the surface of the base material;

(e) impregnating the surface of the base material and elastomer obtained in the step (d) with a condition polymer solution; and (f) curing the condition polymer impregnated in the surface of the base material and elastomer and partially filling the condition polymer into the first continuous pores to form a plurality of second continuous pores.

According to the invention, any base material comprising fibers can be applied in the invention. Preferably, the base material is a non-woven fabric, and more preferably, the base material is a rolled non-woven fabric. The rolled nonwoven fabric can be used in a roll to roll way that improves batch uniformity in comparison with a conventional method of producing a single polishing pad involving molding or casting.

As used herein, the term "fibers" comprise a core and a cladding surrounding the core. The cladding comprises a hydrophobic polymer. Artisans skilled in this field can choose suitable kinds of fibers and coordinate the elastomer and/or condition polymer with the fibers according to the disclosure of the specification. Preferably, the fibers are made of at least one material selected from the group consisting of polyamide, terephthalamide, polyester, polymethyl methacrylate, polyethylene terephthalate, polyacrylonitrile, and mixture thereof. Preferably, the core comprises nylon. In another aspect, the cladding comprises polyethylene terephthalate. Such fibers have the advantages of these two materials and avoid the defects of these two materials. The polyethylene terephthalate cladding remains its good hydrophobic property and prevents the fibers from the influence of the slurry. Furthermore, the nylon core makes the fibers soft, and the substrate to be polished is free of scratch.

The fibers of the surface of the base material provide protrusions for polishing and also provide a scaffold allowing the elastomers and condition polymers deposed in the space defined by the scaffold. In order to have a satisfied function, the length of the fibers is preferably from 0.5 cm to 10.5 cm, i.e., defined as a "short fiber" in this field.

As used herein, the term "elastomer," also known as "elastic polymer," refers to a type of polymer that exhibits rubber-like qualities. When polishing, the elastomer serves as a good buffer to avoid scraping the surface of the substrate to be polished. In one preferred embodiment of the invention, the elastomers are foam resins. As used herein, the term "foam resin" refers to a material containing a thermoplastic resin and a thermodecomposing foaming agent. Preferably, the elastomers are at least one selected from the group consisting of polyamide, polycarbonate, polyaminonitrile, polymethacrylate, epoxyl resin, phenolic resins, polymethyl methacrylate, polyaminoester, vinylbenzene polymer, acrylic resin, and polyurethane.

In step (b) of the method, the manner of impregnating the base material with an elastomer solution can be any conventional method of impregnating. The conditions for impregnation are well known to artisans skilled in this field. Suitable solvents used in the elastomer solution include dimethylformamide (DMF). The elastomer solution optionally comprises additives such as a detergent. Preferably, the elastomer has a concentration ranging from 2 wt % to 60 wt % in the elastomer solution.

Preferably, step (b) further comprises impregnating the entire base material with the elastomer solution.

In step (c) of the method, the manner of coagulating the elastomer impregnated in the base material to mold the elastomer and to form a plurality of first continuous pores contained in the elastomers and fibers can be any conventional method of coagulating. In one embodiment of the invention, the base material is put into a curing solution for coagulating. Preferably, the step comprises treating the base material and the elastomer with dimethylformamide in water, preferably, 0 to 40 wt % dimethylformamide in water. The conditions for curing are well known to artisans skilled in this field. Preferably, the coagulating is carried out at room temperature and pressure.

In one preferred embodiment of the invention, the method of producing a polishing pad further comprises a step (c1) of washing the base material after step (c). The manner of washing can be any conventional method of washing. In one embodiment of the invention, water is used in washing and extrusion wheels are optionally used. The conditions for washing are well known to artisans skilled in this field. Preferably, the base material is washed in water at 50 to 90° C. and then subjected to the extrusion wheels several times.

In one more preferred embodiment of the invention, the method of producing a polishing pad further comprises a step (c2) of drying the base material after step (c1). The manner of drying can be any conventional method of drying. The conditions for drying are well known to artisans skilled in this field. In one embodiment of the invention, the drying is air-drying, and the drying temperature is in the range of 100° C. to 160° C.

The method according to the invention comprises step (d) for planarizing the surface of the base material. Such process removes a protrusion occurring on the surface of the base material. Preferably, the step (d) comprises mechanically polishing the surface of the base material and the elastomer. The manner of mechanically polishing can be any conventional method of mechanically polishing, such as using a sand blast. The conditions for mechanically polishing are well known to artisans skilled in this field. More preferably, the fibers are exposed to the surface of the base material after mechanically polishing.

As used herein, the term "condition polymer" refers to a polymer for use in changing properties of the surface of the base material obtained in the step (d) of the method according to the invention. Because a plurality of first continuous pores are formed and contained in the elastomer and fibers, some properties such as hardness, saturation degree, modulus, or hydrophilicity of the polishing pad may not be satisfied during application. The condition polymers serve as a condition agent for adjusting all of these properties to the best when application. The second continuous pores formed in the polishing pad are smaller than the first continuous pores. The kind and amount of the condition polymers can be determined according to the kind and amount of the elastomer and the substrate to be polished. In one preferred embodiment of the invention, the condition polymers are detergent polymers, hardness mediating polymers, saturation degree mediating polymers, modulus mediating polymers, or hydrophilicity mediating polymers. In one more preferred embodiment of the invention, the condition polymers are at least one selected from the group consisting of polyamide, polycarbonate, polyaminonitrile, polymethacrylate, epoxyl resin, phenolic resins, polymethyl methacrylate, polyaminoester, vinylbenzene polymer, acrylic resin, polyurethane, hydroxyl-containing polymer, silicon-containing hydrophobe, and fluoride-containing hydrophobe. For example, the hardness mediating polymers have the ability to improve the hardness of the pad, and furthermore, the working temperature thereof is lower than the deformation temperature of the base material. Preferably, polyurethane, polymethacrylate and polymethyl methacrylate are applicable as the hardness mediating polymers, which benefit the polishing efficiency without affecting the uniformity and flatness of the pad. In another aspect, the hydrophilicity mediating polymers comprise hydrophile and hydrophobe. The hydroxyl-containing polymers are suitable for the hydrophile. The hydrophobe is preferably silicon- or fluoride-containing hydrophobe.

In step (e) of the method, the manner of impregnating the surface of the base material and elastomers obtained in step (d) with a condition polymer solution can be any conventional method of impregnating. The conditions for impregnation the base material with a condition polymer are well known to artisans skilled in this field. Suitable solvents used in the condition polymer solution include water, methyl-ethyl ketone (MEK) and toluene. Among the solvents, water is preferred because it has the ability to adjust a broad range of viscosity and polymer content of the condition polymer solution. Furthermore, water permeates into the base material much easily. The condition polymer solution optionally comprises additives such as resistant form solution (deformer), and thickener. Preferably, the condition polymer has a concentration ranging from 10 wt % to 100 wt % in the elastomer solution.

Preferably, step (e) comprises impregnating the entire base material with the condition solution. In the embodiment, the polishing pad can continuously provide a surface for polishing, and the number times of retooling the polishing pad is thus reduced.

In step (f) of the method, the manner of curing the condition polymers impregnated in the surface of the base material and the elastomers can be any conventional method for curing. The conditions for curing are well known to artisans skilled in this field. Preferably, step (f) comprises air curing the surface of the base material.

In one more preferred embodiment of the invention, the method of producing a polishing pad further comprises a step (f1) of drying the surface of the base material after step (f). The manner of drying can be any conventional method of drying. The conditions for drying are well known to artisans skilled in this field. In one embodiment of the invention, the drying is air-drying, and the drying temperature is in the range of 100° C. to 170° C. Preferably, the curing step and the drying step are conducted simultaneously.

Preferably, the method of producing a polishing pad further comprises a step (f2) of mechanically polishing the surface of the base material, the elastomers and the condition polymers after step (f1). The manner of mechanically polishing can be any conventional method of mechanically polishing. The conditions for mechanically polishing are well known to artisans skilled in this field. More preferably, the fibers are exposed to the surface of the base material after mechanically polishing.

In one preferred embodiment of the invention, steps (b) and (c) are repeated several times. The kind of the elastomer used in each time can be different or the same.

In another preferred embodiment of the invention, steps (e) and (f) are repeated several times. The kind of the condition polymer used in each time can be different or the same.

According to the present invention, the elastomers are different from or the same as the condition polymers. In one preferred embodiment of the invention, the elastomers are different from the condition polymers.

The polishing pad produced according to the method of the invention has a plurality of continuous pores embedded in the elastomers, condition polymers and fibers. The continuous pores of the polishing pad have an even size, which benefit flow of polishing fluid and distribution of polishing particle and removal of polishing residues. In a preferred embodiment of the invention, the continuous pores have a pore size ranging from 0.1 μm to 500 μm.

The polishing pad produced according to the method of the invention can avoid the defects of conventional polishing pads produced by molding thermoplastic foam resin because the base material of the invention is not formed by molding and its properties will not be influenced by molding. Both the flatness and batch uniformity of the polishing pad according to the invention are better than conventional ones. Furthermore, the method of the invention is also free of thermocompression and lamination, so that the polishing pad according to the invention does not damage the surface of the substrate to be polished. Besides, the polishing efficiency is satisfied when the polishing pad according to the invention is applied.

The invention also provides a polishing pad comprising a base material, which has a surface for polishing a substrate, wherein the surface comprises a plurality of fibers, elastomers and condition polymers, and a plurality continuous pores are embedded in the fibers, elastomers and condition polymers.

The present invention also provides a method of polishing a substrate comprising using a polishing pad to polish a surface of the substrate, wherein the polishing pad comprising a base material having a surface for polishing the substrate, wherein the surface comprises a plurality of fibers, at least one elastomer and at least one condition polymer, and a plurality of continuous pores are embedded in the fibers, elastomer and condition polymer.

The following examples are given for the purpose of illustration only but not intended to limit the scope of the present invention.

EXAMPLE

Base Material. Composite fibers of Nylon® for forming a core and polyethylene terephthalate (PET) for forming a cladding with a fineness of 3 denier formed a non-woven fabric base material, wherein the ratio of Nylon® to PET is 7:3. The thickness of the base material was 2.25 mm, the density was 0.22 g/cm$^3$ and the weight of area unit was 496 g/m$^2$.

Impregnating. The base material was impregnated in an elastomer solution comprising 49 wt % polyaminoester, 49 wt % solvent and 2 wt % detergent.

Curing. The base material, after impregnating, was put into a curing solution comprising 18 wt % dimethylformamide in water to mold the elastomer impregnated in the fibers.

Washing. The residues and the excess curing solution were removed by extrusion wheels. The base material was then washed in water at 80° C. and then subjected to the extrusion wheels for several times.

Drying. The base material, after washing, was then dried at 140° C.

Publishing. After drying, the base material was subjected to mechanically polishing with #150 and #400 sand paper at 1200 and 1300 rpm, and a 1.28 mm semi-product (1) with a flat surface was obtained.

Impregnating and curing. The 1.28 mm semi-product was impregnated in a condition polymer solution containing 75 wt % polymethyl methacrylate. The extrusion wheels were applied for assisting impregnating. The impregnated semi-product was then subjected to curing at 125° C.

Drying. The base material was then dried for removing excess water, and a polishing pad (2) was obtained.

Figure 1B:
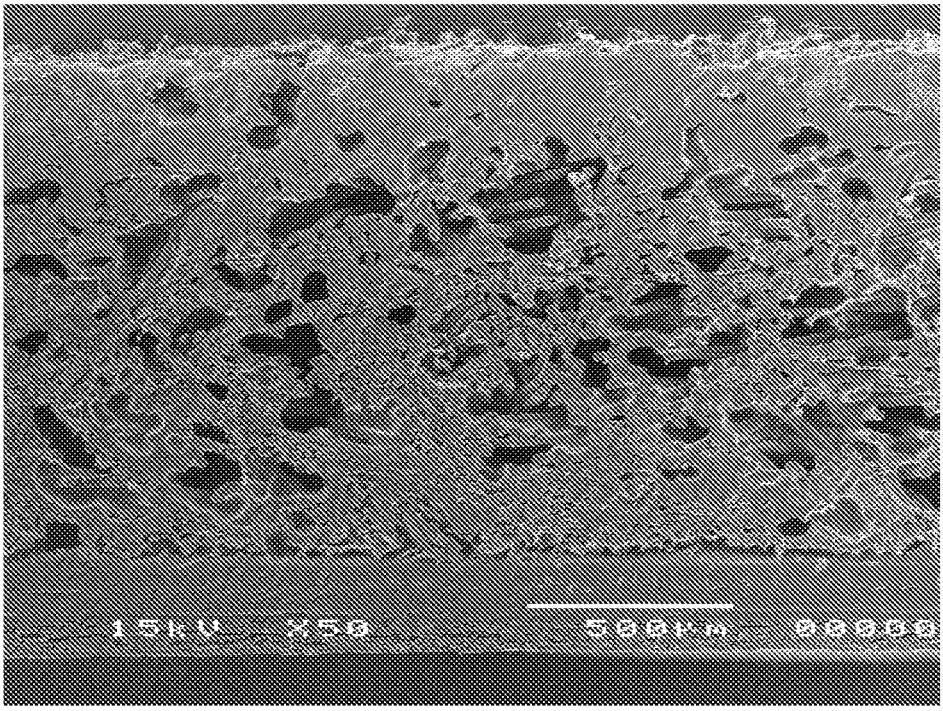

Assaying. The polishing pad (2) obtained and the semi-product (1) were subjected to property assays. The material of the substrate to be polished was silicon dioxide, and the equipment used was IPEC372. The results were shown in Table 1 and FIG. 1. They proved that both the hardness and compression rate are improved after the treatment with condition polymers. The density was also increased after the treatment.

TABLE 1

| | Hardness of shore A | Hardness of shore D | Compression rate (%) | Density ($g/cm^3$) |
|---|---|---|---|---|
| Semi-product (1) | 75 | 30 | 3.5 | 0.45 |
| Polishing pad (2) | 95 | 54 | 2.2 | 0.70 |

The polishing pad (2) obtained and the semi-product (1) were positioned on a chemical mechanical polishing apparatus for assaying polishing properties. The results were shown in Table 2. They showed that the removal rate is raised after the treatment with condition polymers, and the non-uniformity is decreased also.

TABLE 2

| | Removal rate (Å/min) | Non-uniformity (%) |
|---|---|---|
| Semi-product (1) | 1556 | 5.04 |
| Polishing pad (2) | 1855 | 4.50 |

While embodiments of the present invention have been illustrated and described, various modifications and improvements can be made by persons skilled in the art. The embodiments of the present invention are therefore described in an illustrative but not restrictive sense. It is intended that the present invention is not limited to the particular forms as illustrated, and that all the modifications not departing from the spirit and scope of the present invention are within the scope as defined in the appended claims.

The invention claimed is:

1. A method of producing a polishing pad, comprising steps of:

(a) providing a base material comprising a plurality of fibers; said base material having a surface for polishing a substrate, wherein the fibers comprise a core and a cladding surrounding the core, and the cladding comprises a hydrophobic polymer, wherein the core comprises nylon and the cladding comprises polyethylene terephthalate;

(b) impregnating the surface of the base material with an elastomer solution;

(c) coagulating the elastomer impregnated in the surface of the base material to mold the elastomer and to form a plurality of first continuous pores between the elastomer, and between the elastomer and the fibers;

(d) planarizing the surface of the base material;

(e) impregnating the surface of the base material and elastomer obtained in the step (d) with a condition polymer solution; and (f) curing the condition polymer impregnated in the surface of the base material and elastomer and partially filling the condition polymer into the first continuous pores to form a plurality of second continuous pores.

2. The method according to claim 1, wherein the base material is a non-woven fabric.

3. The method according to claim 2, wherein the base material is a rolled non-woven fabric.

4. The method according to claim 1, wherein a-the length of the fibers is from 0.5 cm to 10.5 cm.

5. The method according to claim 1, wherein the elastomers are foam resins.

6. The method according to claim 1, wherein the elastomers are at least one selected from the group consisting of polyamide, polycarbonate, polyaminonitrile, polymethacrylate, epoxyl resin, phenolic resins, polymethyl methacrylate, polyaminoester, vinylbenzene polymer, acrylic resin, and polyurethane.

7. The method according to claim 1, wherein step (b) further comprises impregnating the entire base material with the elastomer solution.

8. The method according to claim 1, wherein step (c) comprises treating the base material and the elastomer with dimethylformamide in water.

9. The method according to claim 1, further comprising a step (c1) of washing the surface of the base material after the step (c).

10. The method according to claim 8, further comprising a step (c2) of drying the surface of the base material after the step (c1).

11. The method according to claim 1, wherein step (d) comprises mechanically polishing the surface of the base material and the elastomers.

12. The method according to claim 1, wherein the condition polymers are detergent polymers, hardness mediating polymers, saturation degree mediating polymers, modulus mediating polymers, or hydrophilicity mediating polymers.

13. The method according to claim 1, wherein the condition polymers are at least one selected from the group consisting of polyamide, polycarbonate, polyaminonitrile, polymethacrylate, epoxyl resin, phenolic resins, polymethyl methacrylate, polyaminoester, vinylbenzene polymer, acrylic resin, polyurethane, hydroxyl-containing polymer, silicon-containing hydrophobe, and fluoride-containing hydrophobe.

14. The method according to claim 1, wherein step (e) further comprises impregnating the entire base material with the condition polymer solution.

15. The method according to claim 1, wherein step (f) comprises air curing the surface of the base material.

16. The method according to claim 15, further comprising a step (f1) of drying the surface of the base material after the step (f1).

17. The method according to claim 1, further comprising a step (f2) of mechanically polishing the surface of the base material, the elastomers and the condition polymers.

18. The method according to claim 1, wherein steps (b) and (c) are repeated for several times.

19. The method according to claim 1, wherein steps (e) and (f) are repeated for several times.

20. The method according to claim 1, wherein the elastomers are different from the condition polymers.

21. The method according to claim 1, wherein the second continuous pores have a pore size ranging from 0.1 μm to 500 μm.

* * * * *